US005276427A

United States Patent [19]

Peterson

[11] Patent Number: 5,276,427

[45] Date of Patent: Jan. 4, 1994

[54] AUTO-ADJUST MOTION DETECTION SYSTEM

[75] Inventor: John Peterson, Toronto, Canada

[73] Assignee: Digital Security Controls Ltd., Downsview, Canada

[21] Appl. No.: 726,696

[22] Filed: Jul. 8, 1991

[51] Int. Cl.[5] ..... G08B 19/00

[52] U.S. Cl. ..... 340/522; 340/506; 340/521; 340/565; 367/93; 367/94

[58] Field of Search ..... 340/522, 506, 521, 565; 367/93, 94

[56] References Cited

U.S. PATENT DOCUMENTS

| | | | |
|---|---|---|---|
| 4,437,089 | 3/1984 | Achard | 340/522 |
| 4,660,024 | 4/1987 | McMaster | 340/522 |
| 4,710,750 | 12/1987 | Johnson | 340/522 |
| 4,764,755 | 8/1988 | Pedtke et al. | 340/522 |
| 4,833,450 | 5/1989 | Buccola et al. | 340/522 |
| 5,077,548 | 12/1991 | Dipoala | 340/522 |

*Primary Examiner*—Donnie L. Crosland

[57] ABSTRACT

An improved dual sensor motion detection system is disclosed wherein the sensitivity of at least one of the sensors is adjusted in accordance with the response signals or signal history received from the sensors. This arrangement has application for systems having at least two sensors and simplifies installation and adjustment of the system.

10 Claims, 2 Drawing Sheets

AUTO-ADJUST MOTION DETECTION SYSTEM

FIELD OF THE INVENTION

The present invention relates to motion detection systems and in particular relates to motion detection systems having at least two sensors and processing the signal of the sensors for producing various system control signals depending upon the responses of the sensors.

BACKGROUND OF THE INVENTION

Dual sensor motion detection systems are quite common and various arrangements have been proposed for processing the signals of such dual sensor motion detection systems to reduce the possibility of false alarms. An alarm signal is normally only produced when both sensors confirm within a particular time period the presence of motion or a body in the room. Some systems, further process the signals whereby if a certain sensor is determined as having failed, the system produces a trouble indication or possibly an alarm when the one active sensor is activated or has been activated a number of times.

Other arrangements for processing signals in a motion detection system having at least two sensors are shown in U.S. Pat. No. 4,710,750 (Johnson), U.S. Pat. No. 4,195,286 (Galvin), U.S. Pat. No. 4,611,197 (Sansky), and U.S. Pat. No. 4,833,450 (Buccola et al).

Such systems, when installed, have the sensors adjusted to a certain sensitivity and in some cases where the system is oversensitive, an installer must return to the installation and readjust the system.

There remains a need for a simple system which is easy to install and is easy to operate by the end user.

SUMMARY OF THE INVENTION

In a dual sensor motion detection system having at least two sensors monitoring a common area, an improvement, according to the present invention, comprises a processing arrangement which receives the output of the sensors and during operation, automatically adjusts the sensitivity of at least one of the sensors within a predetermined range when an unconfirmed event occurs determined by a single response being received from the sensors within a predetermined time interval and operating to produce a trouble indication based on receiving a predetermined number of unconfirmed events after the sensitivity of one of the sensors has been adjusted and reached a predetermined sensitivity level.

According to an aspect of the invention, the predetermined sensitivity level includes a predetermined minimum sensitivity and a predetermined maximum sensitivity. If either the maximum or minimum sensitivity level is reached, the processing arrangement will thereafter produce a trouble indication based on receiving a predetermined number of unconfirmed events.

According to a further aspect of the invention, the sensors of the dual motion detection system are of different types.

According to a further aspect of the invention, the sensors are of the type selected from the group consisting of microwave, passive infrared, and ultrasonic sensors.

According to a further aspect of the invention, one of the sensors is a passive infrared sensor and the sensitivity thereof is not adjusted during operation of the system, and wherein the sensitivity of the other sensor is automatically increased when the passive infrared sensor responds and the other sensor does not respond, and wherein the sensitivity of the other sensor is decreased when the passive infrared does not respond and the other sensor does respond.

According to yet a further aspect of the invention, the system includes an arrangement for adjusting an incremental amount by which the sensitivity of one of the sensors is adjusted.

According to yet a further aspect of the invention, the system for adjusting the sensitivity of one of the sensors varies the level of the incremental amount in accordance with the operation of the system and preferably as a function of time from power-up of the system.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
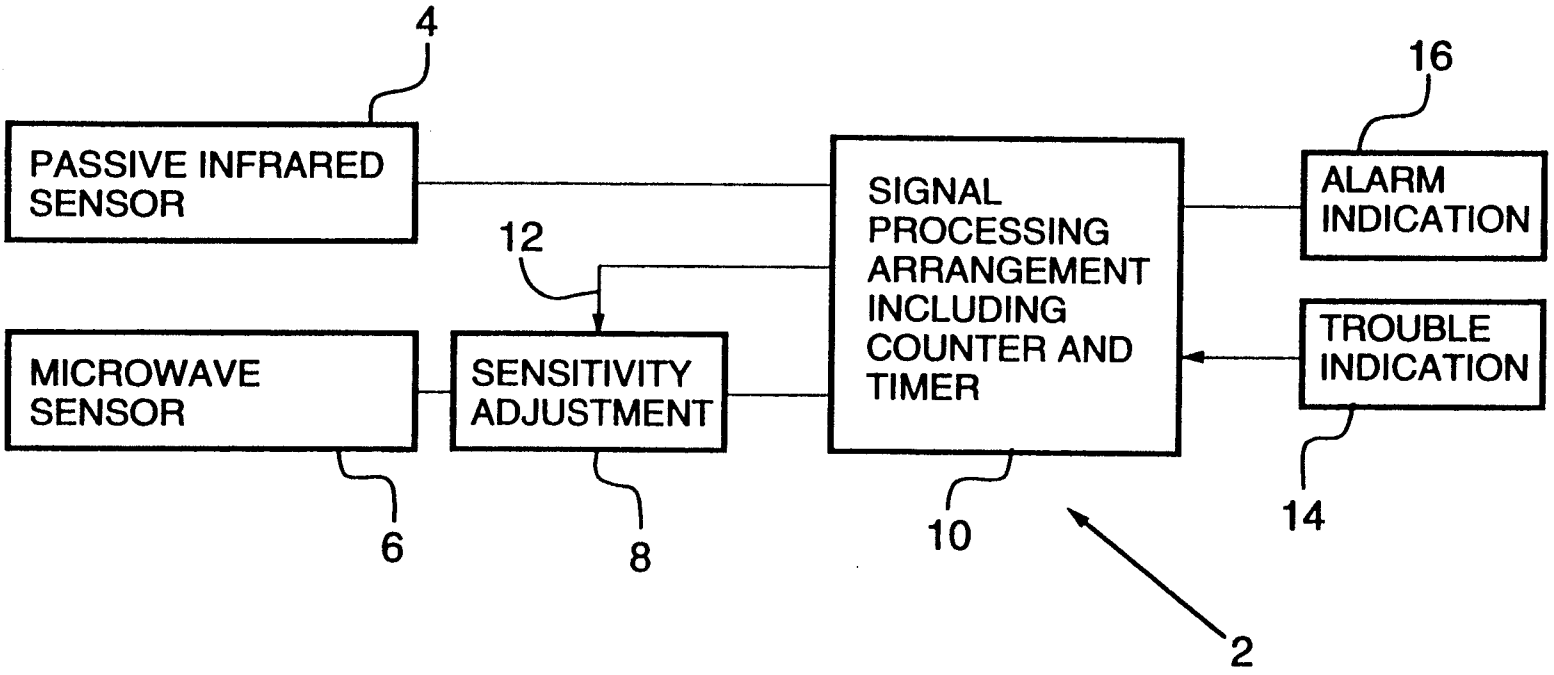
FIG. 1 is a schematic showing the dual motion detection system.

The dual sensor motion detection system, generally shown as 2, includes a passive infrared sensor 4 and a microwave sensor 6. Associated with the microwave sensor is a sensitivity adjustment 8. The signal processing arrangement 10 includes a counter and timer with this signal processing arrangement causing either a trouble indication 14, or an alarm indication 16 when required. The signal processing arrangement 10 is connected to the sensitivity adjustment 8 by means of the connection 12. With this particular arrangement, the installer has reduced setup requirements and the remaining setup requirements are significantly simplified once the mounting and wiring of the motion detection system 2 has been completed. As soon as power is supplied to the system and there is activity in and around the desired area of coverage, the system will begin to automatically adjust the sensors so that detection coverage is equalized. On power-up, the passive infrared sensor is preset for maximum coverage and is not automatically adjustable. The microwave sensor is initialized at maximum coverage. Any activity in the area of coverage will then cause adjustment of the system. For example, if there is a confirmed alarm, i.e. response is being received from each of the sensors, the coverage remains unchanged. Similarly, if there are no detections received from the sensors, the system remains unchanged. If there is a microwave detection and no confirming passive infrared detection, then the sensitivity of the microwave sensor is incremented downward to reduce its coverage. This is all carried out by the signal processing arrangement 10 by varying the sensitivity adjustment 8. The sensitivity of the microwave system cannot be set below a minimum value to ensure that some coverage is maintained.

In contrast, if there is a passive infrared detection without a confirming microwave detection, then the sensitivity of the microwave sensor is incremented upward to increase its coverage. The sensitivity of the microwave sensor cannot be set above a predetermined or preset maximum value.

The signal processing arrangement also includes a timing arrangement and varies the incremental change to the sensitivity of the microwave sensor as a function of time. For example, the first adjustment could be of the order of ±10% and with increasing time from power-up, the sensitivity could be changed to eventually reach ±0.1%. The assumption here is that after an initial period, sufficient activity has taken place to bring the microwave subsystem coverage into reasonable equality with the passive infrared subsystem coverage. Furthermore, the signal processing arrangement 10 can also reduce the adjustment increments as a function of activity. For example, if a hundred adjustments have been made in a very short time, the adjustment increment could be reduced from an initial ±10% to the final ±0.1%. Therefore, the incremental value can vary as a function of time from start-up or experienced activity or a combination of both.

If, at any time after the first power-up, power is interrupted to the unit, the unit reverts to its initial setup. This is a fail-safe mode to ensure maximum coverage.

A trouble determination is desired if either of the sensors fail. In the case of a microwave sensor failure, the system will only detect passive infrared responses and, as a result, will continually attempt to increase the microwave coverage. Once the microwave sensitivity is at the predetermined maximum level, the unit will then count the unconfirmed signals from the passive infrared sensor and, after a preset number, will initiate default operation.

If a confirmed alarm is detected prior to reaching the preset passive infrared default count, then the counter will be reset to zero. It is apparent that such a confirmed alarm would produce the alarm signal.

If the passive infrared sensor has failed, the unit will only detect microwave alarms and as a result, will continually attempt to decrease the microwave coverage. Once the microwave sensitivity is at the predetermined minimum sensitivity level, the unit will then count the unconfirmed alarms from the microwave sensor and, after a preset number, will initiate the default operation.

If a confirmed alarm is detected prior to reaching the preset microwave default count, then the counter will be reset to zero.

The default operation can be selected to be either the remaining single subsystem to initiate an alarm or simply a visual and/or other signalling output which provides a unique trouble indication. In the case of confirmed responses, the alarm would be activated.

Figure 2:
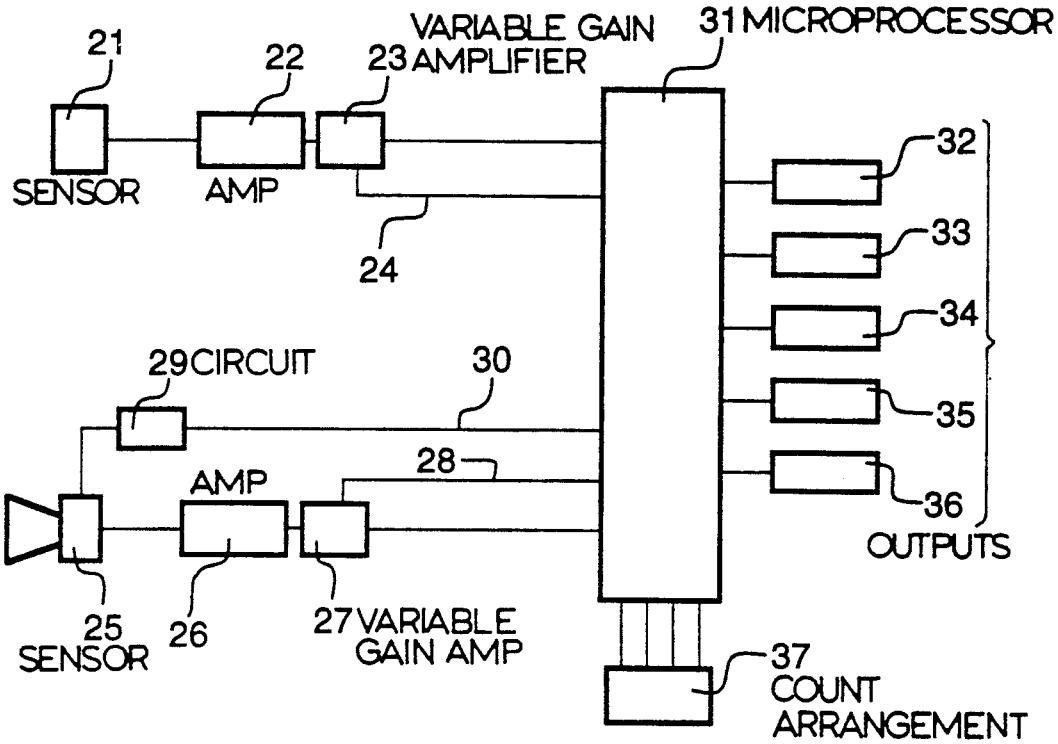
FIG. 2 is a schematic of a system where both sensors are adjustable.

The system shown in FIG. 2 includes a pyroelectric motion sensor 21, signal conditioning and amplification shown as 22, a variable gain amplifier 23 having a range control signal 24. The microwave motion sensor 25 includes signal conditioning and amplification 26, a variable gain amplifier 27, a microwave range control signal 28, microwave feedback control circuit 29, and microwave control signal 30. Variable gain amplifiers 23 and 27 allow for adjustment of the range of the amplifier. The sensors and associated circuitry thereof are then connected to the microprocessor 31 which includes logic and counting capabilities. The arrangement also includes a passive infrared alarm indicator 32, a microwave alarm indicator 33, common alarm indicator 34, common alarm relay output 35, common trouble relay output 36, and jumper inputs to set count level to go to default operation, generally shown as 37. This circuit can also include a memory capability which can store the run settings of the system once the system has stabilized. These settings would then be used to return the system to its normal operation mode after there has been a power cutoff. Obviously, the memory would have to have its own separate power source or be capable of retaining the information with a loss of power.

Figure 3:
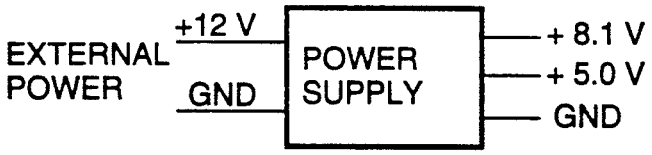
FIG. 3 is a schematic of the power supply for the system.

The system of FIG. 2 is powered by the power supply arrangement shown in FIG. 3. With the system shown in FIG. 2, both sensors are capable of automatic range adjustment. For example, the passive infrared sensor would be set up for maximum coverage on power-up and the microwave sensor would be set for its nominal specified range. The microwave sensor would normally not be adjusted based on motion detection. The first sensor, i.e. the passive infrared sensor, would be adjusted as previously described. In contrast to the one-adjust system, a further adjustment occurs when the first sensor reaches one of its settings. For example, if the passive infrared sensor is automatically adjusted and reaches its minimum setting, subsequent unconfirmed detections by the first sensor would cause the second sensor to be adjusted upward for more range. The second sensor's upward adjustment is limited to a nominal amount consistent with a range for the particular technology that would not cause false detections. Thus, depending upon the type of sensor, a range would be established.

With this method of adjustment, both sensors can be matched at the low end of one sensor range and the system also confirms that the sensor that has been set for minimum is in fact not functioning. As can be appreciated, by increasing the other sensor, detections may be made. Thus, there is some compensation and cross checking between the sensors.

A trouble indication, namely that one of the sensors is not working, would be initiated as described above, but only after the matching attempt of adjusting the second sensor upward had failed to produce confirmed alarms.

As discussed above, this system has the ability to self-adjust to what would be considered proper settings for the environment. Once these settings have been achieved, they can be stored in memory to be recalled when necessary. One possible time would be when power is lost whereby the unit would not have to go through the self-regulation exercise to finally achieve the actual run conditions. These settings can also be used to establish ranges about which either of the sensors can be adjusted. With this type of feature, a jumper is provided that allows the installer to reset to maximum range start-up conditions for situations where the unit is moved to another location or where the shape of the area being covered had changed. In any event, the device would allow the operator to force it to reevaluate and self-regulate to proper run conditions.

As can be appreciated, the present system automatically adjusts the motion sensing subsystems. This concept can be used with a host of different motion detectors and is not limited to the passive infrared microwave combination specifically described. With this system, the installer has no setup other than mounting and wiring in the motion detector and then monitoring the system to determine that it is functioning properly. With this system, the user can easily restart the system and the system continues to adjust in accordance with the response history encountered. The trouble indication is only produced after the sensitivity of one of the sensors has reached a predetermined level. This predetermined level can either be a minimum or maximum, with the system thereafter producing a trouble indication based on further unconfirmed responses. This system is easier to install and easier to operate and has the added advantage of continually adjusting for better cooperation of the sensors.

It is also possible to use this type of system in coordinating more than two sensors, and a predetermined relationship could be used for coordinating, say, three sensors. For example, one sensor could be a passive infrared as described above which is coordinated with each other sensor in the exact manner described above. A further approach would have each sensor act as a base point for one other sensor whereby the sensitivity of all sensors can be automatically adjusted.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. In a dual sensor motion detection system having at least two sensors monitoring a common area where each sensor produces an output signal when activated by a sensed change in state of the common area, and wherein one of said sensors has an adjustable sensitivity, said detection system having a processing arrangement to process the signals from said sensors and produce an alarm when both sensors produce an output signal within a predetermined time interval, said processing arrangement including means for defining a predetermined effective operating range within which the adjustable sensitivity is adjusted, said processing arrangement processing the output signals of said sensors and combining the operation of said at least two sensors by incrementally increasing or decreasing the adjustable sensitivity of said one sensor within the predetermined effective operating range when an unconfirmed event occurs determined by a single output signal being received by said processing arrangement from said sensors within the predetermined time interval; said processing means including means to produce a trouble indication based on said processing arrangement receiving a predetermined number of unconfirmed events after the sensitivity of said one sensor has been incrementally adjusted a plurality of times and reached an end value of said predetermined effective operating range.

2. In a dual sensor motion detection system as claimed in claim 1 wherein said sensors are of different types.

3. In a dual sensor motion detection system as claimed in claim 2 wherein said sensors are of the type selected from the group consisting of microwave, passive infrared and ultrasonic.

4. In a dual sensor motion detection system having at least two sensors with each sensor monitoring a common area where each sensor produces an output signal when activated by a sensed change in state of said common area and at least one of said sensors has an adjustable sensitivity and wherein an alarm is produced when both sensors produce an output signal within a predetermined time interval, the improvement comprising a processing arrangement which includes means for defining a predetermined effective operating range of the adjustable sensitivity of said one sensor, said processing arrangement receiving the output signals of said sensors and during operation automatically adjusts to incrementally increase or decrease the sensitivity of said one sensor within the predetermined effective operating range when an unconfirmed event occurs determined by a single output signal being received by said processing arrangement from one of said sensors within the predetermined time interval, said sensitivity of said one sensor being adjusted to increase the sensitivity of the sensor that did not produce an output signal in the predetermined time interval relative to the sensitivity of the sensor that did produce the output signal; said processing arrangement increasing the sensitivity of said one sensor when an unconfirmed event occurs determined by a single output signal being received and said one sensor did not produce the output signal and decreasing the sensitivity of said one sensor when an unconfirmed event occurs determined by a single output signal being produced by said one sensor and being received by said processing arrangement, said processing arrangement further including means to produce a trouble indication based on said processing arrangement receiving a predetermined number of unconfirmed events after the adjustable sensitivity of said one sensor has been adjusted and is at an end value of said predetermined effective operating range.

5. In a dual sensor motion detection system having at least two sensors monitoring a common area where each sensor produces an output signal when activated by a sensed change in state of the common area, and wherein one of said sensors has an adjustable sensitivity, said system producing an alarm when both sensors produce an output signal within a predetermined time interval, the improvement comprising a processing arrangement which includes means for defining a predetermined effective operating range, said processing arrangement receiving the output signals of said sensors and during operation automatically adjusts the sensitivity of said one sensor within the predetermined range when an unconfirmed event occurs determined by a single output signal being received by said processing arrangement from said sensors within the predetermined time interval; sand processing means including means to produce a trouble indication based on said processing arrangement receiving a predetermined number of unconfirmed events after the adjustable sensitivity of said one sensor has been adjusted and reached a predetermined sensitivity level and wherein one sensor is passive infrared and the sensitivity thereof is not automatically adjusted during operation of the system and wherein the sensitivity of said one sensor is automatically increased when the passive infrared sensor produces an output signal and said one sensor does not produce an output signal within the predetermined time interval and wherein the sensitivity of said one sensor is decreased when said one sensor produces an output signal and said passive infrared does not produce an output signal within the predetermined time interval.

6. A motion detection system comprising at least two sensors monitoring a common area with each sensor producing an output signal when motion is detected, at least one of said sensors having an adjustable sensitivity, a process arrangement which receives and processes the output signals from the sensors and produces an alarm signal when both sensors produce output signals within a predetermined time interval, said processing arrangement incrementally adjusting the sensitivity of said at least one sensor within a predetermined effective operating range of the at least one sensor by increasing or decreasing the sensitivity thereof when an unconfirmed event occurs determined by said processing arrangement receiving output signal from one sensor which is not confirmed by receiving an output signal from the other sensor within the predetermined time interval;

said processing arrangement processing said signals and producing a trouble indication when said processing arrangement receives a predetermined number of unconfirmed events after the sensitivity of said at least one sensor has been adjusted a plurality of times and reached a predetermined sensitivity level.

7. A motion detection system as claimed in claim 6 wherein said system includes means for adjusting an incremental amount by which the sensitivity is adjusted.

8. A motion detection system as claimed in claim 7 wherein said means for adjusting varies the level of said incremental amount in accordance with the operation of the system.

9. A motion detection system as claimed in claim 8 wherein said incremental amount is varied as a function of the time from power-up of the system.

10. A motion detection system as claimed in claim 8 wherein said incremental amount is varied as a function of the rate of receiving responses from said sensors.

* * * * *